US007334719B1

(12) United States Patent
Fisher

(10) Patent No.: US 7,334,719 B1
(45) Date of Patent: Feb. 26, 2008

(54) BANKING ENVELOPE AND METHOD OF USE

(76) Inventor: David L. Fisher, 142 W. Greenfield, Lombard, IL (US) 60148

( * ) Notice: Subject to any disclaimer, the term of this patent is extended or adjusted under 35 U.S.C. 154(b) by 626 days.

(21) Appl. No.: 10/792,118

(22) Filed: Mar. 3, 2004

(51) Int. Cl.
*B65D 27/14* (2006.01)
*B65D 27/00* (2006.01)
*B65D 27/22* (2006.01)

(52) U.S. Cl. ..... 229/80.5; 229/75; 229/84

(58) Field of Classification Search ..... 229/72, 229/82, 84, 306, 80.5, 75
See application file for complete search history.

(56) References Cited

U.S. PATENT DOCUMENTS

| | | | | | |
|---|---|---|---|---|---|
| 290,179 | A | * | 12/1883 | D'Opdorp | 283/56 |
| 594,620 | A | * | 11/1897 | Harris | 229/75 |
| 673,471 | A | | 5/1901 | McCord | |
| 835,850 | A | | 11/1906 | Cohn | |
| 1,424,345 | A | | 8/1922 | Healy | |
| 1,998,989 | A | * | 4/1935 | Greve | 229/87.01 |
| 2,745,595 | A | | 5/1956 | Kelly | |
| 2,863,599 | A | * | 12/1958 | Whitman | 229/72 |
| 3,356,285 | A | * | 12/1967 | Greason | 229/70 |
| 3,381,888 | A | * | 5/1968 | Lewis, Jr. et al. | 229/72 |
| 3,642,195 | A | | 2/1972 | Tulisalo | |
| 3,858,791 | A | | 1/1975 | Gendron | |
| 3,889,873 | A | | 6/1975 | Clough | |
| 3,926,365 | A | | 12/1975 | Sandstrom | |
| 4,534,581 | A | * | 8/1985 | Engh | 281/15.1 |
| 4,664,417 | A | * | 5/1987 | Rosenstrach et al. | 283/116 |
| 4,865,247 | A | * | 9/1989 | Grabner | 229/92.1 |
| 5,400,954 | A | * | 3/1995 | Kaye | 229/75 |
| 5,487,566 | A | * | 1/1996 | Hedge, Jr. | 283/56 |
| 6,108,672 | A | * | 8/2000 | DeJoseph | 715/505 |
| 6,974,157 | B1 | * | 12/2005 | Hammon | 281/15.1 |

FOREIGN PATENT DOCUMENTS

| | | |
|---|---|---|
| EP | 1 096 435 A2 | 9/2000 |
| GB | 2 070 561 A | 3/1980 |

* cited by examiner

*Primary Examiner*—Jes F. Pascua
(74) *Attorney, Agent, or Firm*—Robert L. Marsh

(57) ABSTRACT

A banking envelope is made from a blank of material such as paper. The blank has a rectangular back panel, a front panel, a side flap opposite the front panel, and opposing end flaps. The assembled envelope has advertising material printed on the visible surfaces thereof. A portion of the advertising material promotes the banking institution from which the envelope is issued and other portions of the advertising material promotes at least one unrelated business institution located in near proximity to the banking institution.

4 Claims, 3 Drawing Sheets

BANKING ENVELOPE AND METHOD OF USE

This present invention relates to the banking industry and in particular to an improved banking envelope suitable for transferring bank funds.

BACKGROUND OF THE INVENTION

Drive-up banking windows are now common for banks, and a large percentage of banking transactions resulting in cash being returned to depositors occur through drive-up windows. To transfer funds to the depositor, banks use a suitable envelope for transferring cash. The envelope must be sized to contain paper and coin currency and must be simple and inexpensive to manufacture. If the bank does not charge for teller transactions, the cost of the envelopes is born solely by the bank. A bank may undertake hundreds or thousands of cash transactions during any week and therefore the cost of the envelopes may be a significant line item on the cost of operating a bank. It would be desirable for banks, therefore, to find a method on which the cost of the banking envelope is significantly reduced.

Existing bank envelopes are made of folded and glued paper and have advertising on the surfaces thereof for promoting the facilities of the bank from which the envelope is issued. As a practical matter, however, a depositor who desires to withdraw funds from a banking institution is generally familiar with the services rendered by the institution from which the funds are withdrawn. From the standpoint of the depositor, the advertising merely identifies the institution, for the purposes of distinguishing those funds from others withdrawn from another institution. Also, the printing of advertising information on the surface of an envelope increases the cost of the envelope. It is therefore not uncommon for one or more of the panels which form the banking envelope to be left blank.

SUMMARY OF THE INVENTION

Briefly, the present invention is embodied in a banking envelope for use by the banking industry for transferring funds from the institution to a depositor. In the preferred embodiment the envelope is made from a blank of material having a generally rectangular back panel having parallel long sides, parallel short sides, and an inner surface and an outer surface. Attached to the back panel is a generally rectangular inside panel having parallel long sides, opposing short sides, and inner and outer surfaces, with the inside panel joined to the back panel along a long side that is common to both the back panel and the inside panel.

The blank from which the envelope is made further has a generally rectangular front panel having opposing long sides and opposing short sides with one of the long sides of the side flap hingeably attached along the second long side of the back panel. The blank is folded along the common long side between the back panel and the inside panel and along the common long side between the back panel and the front panel with the front panel folded over the inside panel. The blank is then folded along the common side between the back panel and the first end panel so that the first end panel overlaps the front panel and is retained against the front panel by an adhesive. A second end flap having opposing sides has one of the opposing sides in common with the second short side of the back panel and is hingeably attached thereto such that the second end flap is foldable against a surface of the front panel. A slot is provided in either the front panel or in the second end flap and a tab is provided on the other of the front panel and second end of the front panel and second end flap for engagement with the slot for removably retaining the second flap against the front panel.

When an envelope in accordance with the invention is assembled and folded around a quantity of paper and coin currency to be transferred to a depositor, an outer surface of the back panel and an outer surface portion of the front panel and of the first and second end panels will be visible to a customer and suitable for receiving printed advertising thereon. Advertising material referring to the banking institution that issues the banking envelope is applied to the outer surface of the back panel. This advertising can promote features and banking personnel associated with the branch of the bank issuing the envelope. Advertising material related to an institution other than the banking institution issuing the banking envelope is applied to the outer surface of the front panel and the two side flaps. Preferably, the advertising material relating to an institution other than the banking institution issuing the banking envelope has a location in close proximity to the banking institution from which the bank envelope has issued. This advertising material promotes the products or services of a neighboring business institution, and a customer who receives the envelope having cash therein will be notified by virtue of the advertising material printed on the envelope of the products or services of this neighboring institution.

In the preferred embodiment, the common long side between the back panel and the front panel as well as the two short sides of the back panel that join the two end panels are perforated to facilitate the tearing of the blank along these common sides. Also, the adhesive that retains the first end panel over the front panel is non-drying so that the envelope can be disassembled without damaging the panels thereof. An envelope in accordance with the invention may also have coupons from businesses other than the banking institution printed on the surfaces thereof that can be separated by disassembling the envelope and tearing off the panels along the perforations.

The advantage of providing advertising material from another institution other than the bank from which the envelope has issued is that it enables the solicitation of advertising fees from another institution other than the bank from which the envelope has issued. The revenue obtained from promoting the products or services of another business institution can be used to pay for the costs of the banking envelope itself, thereby reducing the cost of doing business of the banking institution.

By employing an envelope bearing advertising from an unrelated, nearby business institution, a banking facility can divest itself entirely of the burdens of providing banking envelopes and have them undertaken by a third party printing or advertising firm. A third party printing or advertising firm can manufacture banking envelopes in accordance with the invention and provide them to one of the offices of a bank without charge to the bank. The cost of the envelopes and the profits of the third party firm are secured from the advertising fees from a second business institution having a facility in near proximity to the bank. A third party printing or advertising firm can obtain enough money from the sale of advertising on the banking envelope such that it can provide the banking envelopes to the banking facility without charge to the banking facility. The cost of providing banking envelopes to customers of the bank is therefore no longer born by the bank.

BRIEF DESCRIPTION OF THE DRAWINGS

A better understanding of the present invention can be had after a reading of the following detailed description taken in conjunction with the drawings wherein.

DETAILED DESCRIPTION OF A PREFERRED EMBODIMENT

Figure 2:
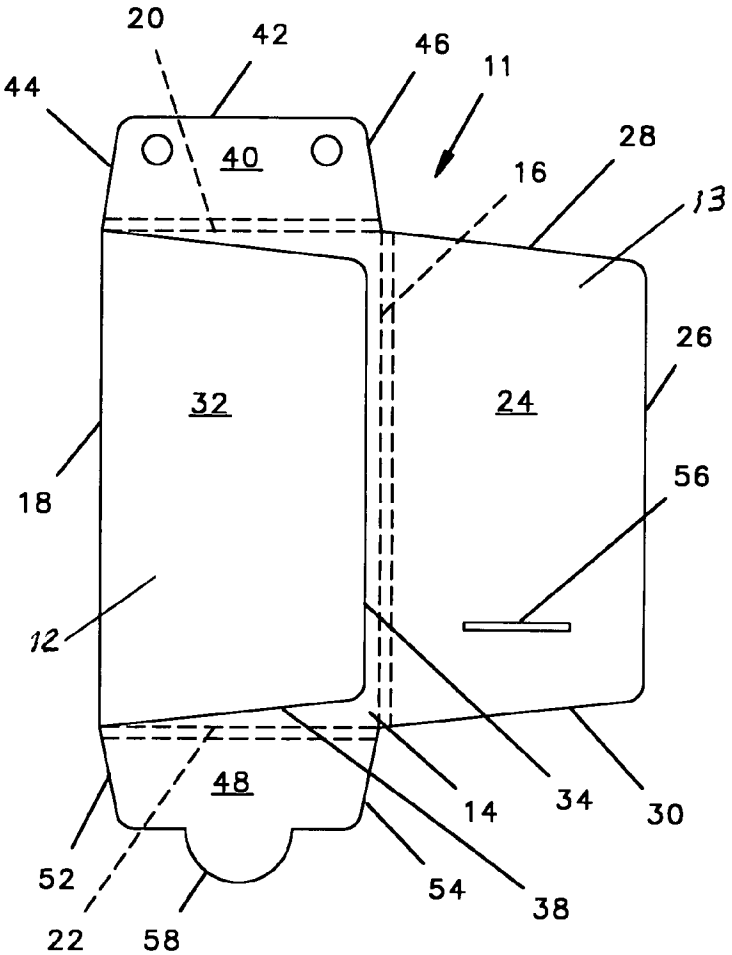
FIG. 2 is a front elevational view of the blank shown in FIG. 1 with the inner panel folded against the back panel.

Referring to FIGS. 1-6, an envelope 10 in accordance with the present invention is made from a blank 11 of a suitable material such as paper. The blank 11 has two opposing surfaces 12, 13, one of which, 12, will become the outer surfaces of the assembled envelope 10 and the other, 13, will become the inner surfaces of the folded envelope 10. For the purposes of this discussion, the entire surface 12 will be described as "outer surface 12" and the opposing surface will be described as "inner surface 13."

The blank 11 has a generally centrally located back panel 14 having spaced parallel long sides 16, 18 and connecting the adjacent ends of the long sides 16, 18, opposing short sides 20, 22. Adjacent the first long side 16 is a generally rectangular front panel 24 having a common long side 16 and an opposing spaced long side 26. Connecting adjacent ends of the long sides 16, 26 of the front panel 24 are first and second short sides 28, 30. Adjacent the second long side 18 of the back panel 14 is an inner panel 32, which is depicted as also being generally rectangular in shape and having long side 18 in common with the back panel 14 and spaced therefrom and generally parallel thereto a second long side 34. Connecting the ends of the generally parallel long sides are first and second short sides 36, 38.

Adjacent the short side 20 of the back panel 14 is a first end flap 40, the borders of which consist of the short side 20 of back panel 14 and spaced therefrom is an outer edge 42. Connecting the ends of outer edge 42 to the ends of short side 20 of back panel 14 are spaced apart side edges 44, 46 respectively. At the opposite side of the back panel 14 and adjacent short side 22 is a second end flap 48, the borders of which include the second short side 22 of back panel 14, and spaced therefrom an outer edge 50 the ends of which are connected to the ends of short side 22 by side edges 52, 54.

An elongate slot 56 is provided in the front panel 24 perpendicular to the long sides 16, 26 thereof and spaced from an extension of short side 22 of back panel 14 a distance equal to the distance between the outer edge 50 of the second flap 48 and the short side 22. The slot 56 is positioned generally midway between the long sides 16 and 26 of front panel 24 and has a length 62 of approximately one-third of the distance between long sides 16 and 26.

Positioned at the distal end of outer edge 50 of the second end flap 48 is a protruding tab 58 which extends outward of the outer edge 50. The tab 58 has an overall width 60 that is less than the overall length 62 of the slot 56.

Figure 4:
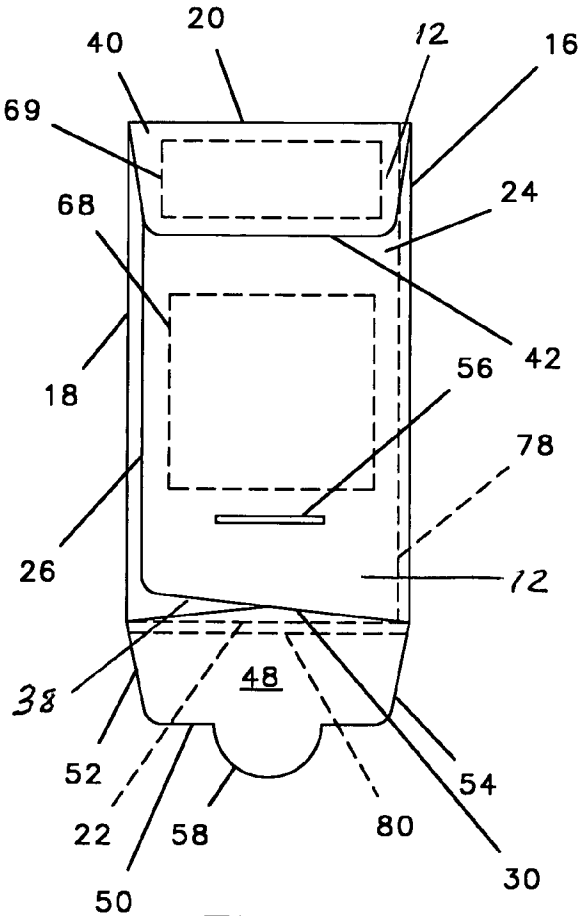
FIG. 4 is a front elevational view of the blank shown in FIG. 1 folded as described with respect to FIG. 3 and with the first end flap folded over the front panel and secured thereto with an adhesive.
Figure 3:
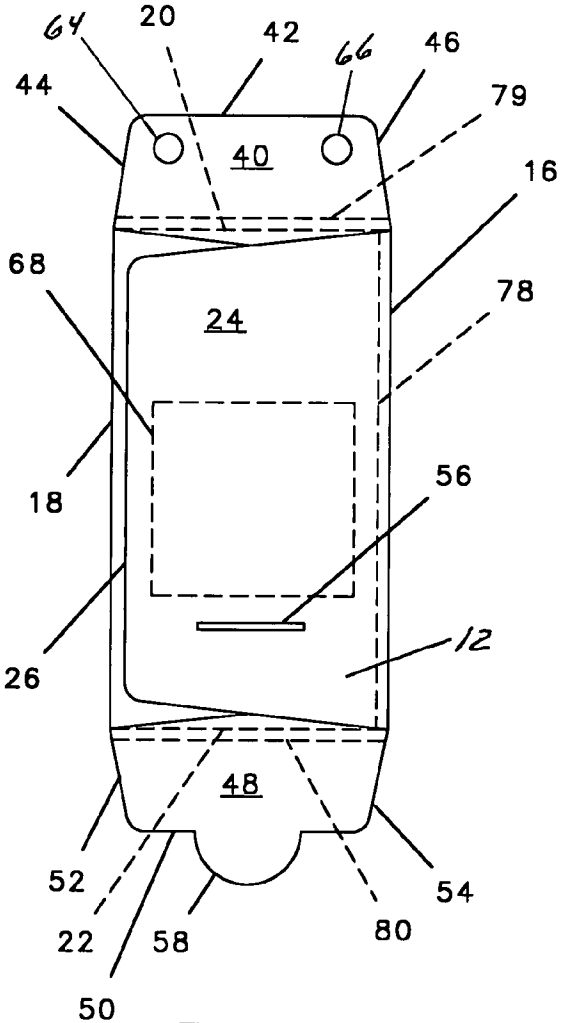
FIG. 3 is a front elevational view of the blank shown in FIG. 1 folded as described with respect to FIG. 2 and with the front panel folded over the inner panel.

To assemble the envelope 10, the blank 11 is first folded along second long side 18 until the inner panel 32 overlaps the back panel 14 as depicted in FIG. 2. Thereafter, the blank 11 is folded along the first long side 16 until the front panel 24 overlaps the inner panel 32 as is shown in FIG. 3. Thereafter, the first end flap 40 is folded along short side 20 of the back panel 14 until the first end flap 40 is positioned on top of the outer surface of the front panel 24. Non-drying adhesive dots 64, 66 applied to the inner surface 13 of the first end flap 40 adheres on contact to the outer surface of the front panel 24 thereby retaining the first end flap 40 against the outer surface of the front panel 24 as depicted in FIG. 4. The non-drying adhesive allows a receiver of the envelope 10 to separate the bonded parts 24, 40 without causing damage to either of the parts 24, 40. The envelope 10 may therefore be disassembled by the receiver of the envelope 10 to separate coupons printed on the panels thereof as further described below.

The envelope 10 is sized to receive currency within the pocket of the envelope between the inner panel 32 and the front panel 24, without requiring that the currency be folded and therefore the outermost dimensions of the back panel 14 are larger than the outermost dimensions of the currency to be received therein.

Figure 5:
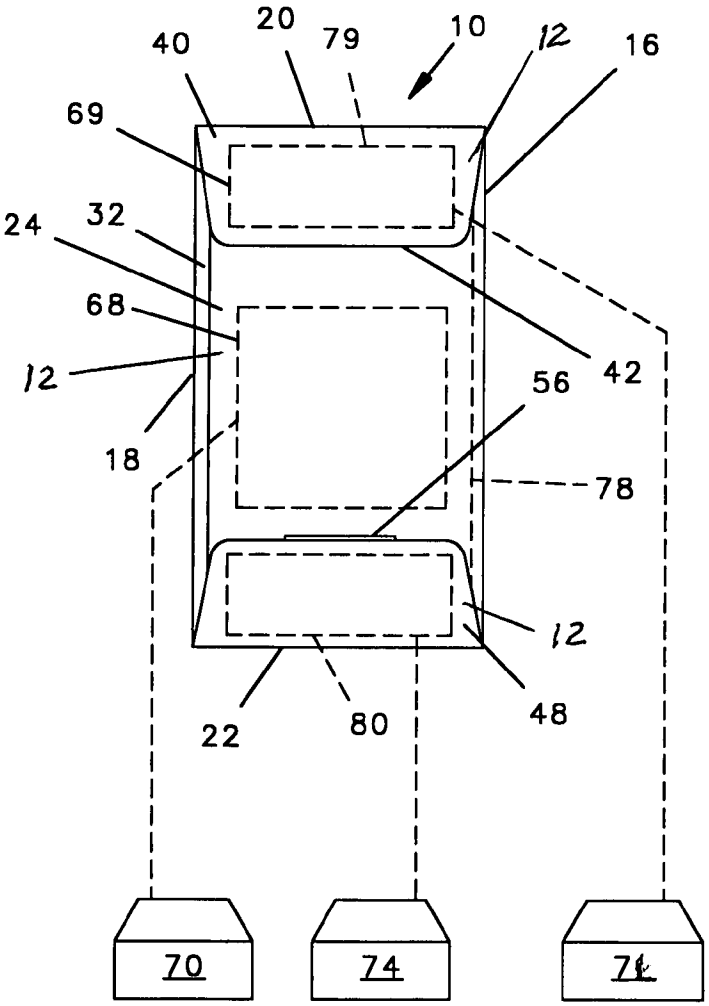
FIG. 5 is a front elevational view of the folded envelope made from the blank shown in FIG. 1 showing advertising material on three panels thereof promoting three businesses that are unrelated to the banking institution from which the envelope is issued.

Coins to be delivered to the customer are inserted in the envelope 10 by sliding them through the open end formed by short side 38 of inner panel 32 and short side 22 of back panel 14. Once the coins are inserted, the panel 11 is folded along short side 22 of the back panel 14 until the second end flap 48 is folded against the front panel 24, as depicted in FIG. 5. As the parts are moved together the tab 58 is inserted into the slot 56 to thereby removably retain the second end flap 48 against the front panel 24. The folded envelope 10 as depicted in FIG. 5 is suitable for retaining cash therein for the purposes of delivering to a customer. Currency is inserted by a bank teller in the pocket between the inner panel 32 and the front panel 24 of the envelope while it is configured as shown in FIG. 5. The removable tab 58 enables the receiver of the envelope 10 to have easy access to the coins contained therein while the currency can thereby be easily removed from the pocket between the front panel 24 and the inner panel 32.

Figure 6:
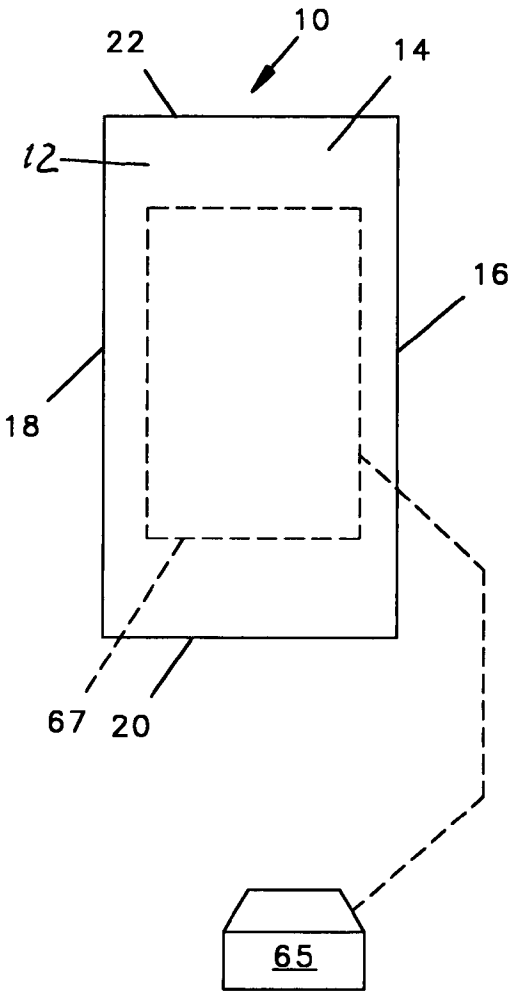
FIG. 6 is a rear elevational view of the envelope folded from the blank shown in FIG. 1 such that advertising material on the back surface thereof, from the financial institution from which the envelope is issued, is visible.

Referring to FIGS. 5 and 6, when a bank customer receives the bank envelope 10 and examines the envelope 10 in his hands, the outer surfaces 12 of the back panel 14 and the first and second end flaps 40, 48 will be visible as will be portions of the front panel 24. In accordance with another feature of the invention, advertising material 67 for the banking institution 65 from which the envelope 10 is issued is printed on the outer surface of the back panel 14.

Also, advertising material 68 from a first institution 70 that is different from the banking institution 65 from which the envelope 10 is issued is applied to the outer surface of the front panel 24. Advertising material 69 from another institution 71 that is also different from the banking institution 65 may be printed on the outer surface of the first end flap 40 and advertising material 72 from a third institution 74 different from the banking institution 65 may be printed on the outer surface of the second end flap 48. Accordingly, a bank customer who receives the bank envelope 10 with cash therein is presented with both advertising material 67 from the banking institution 65 and advertising material 68, 69, 72 related to other business institutions 70, 71, 74. The banking customer is therefore provided with advertising material 68, 69, 72 regarding institutions 70, 71, 74 which are unrelated to the bank 65 issuing the envelope 10.

Figure 1:
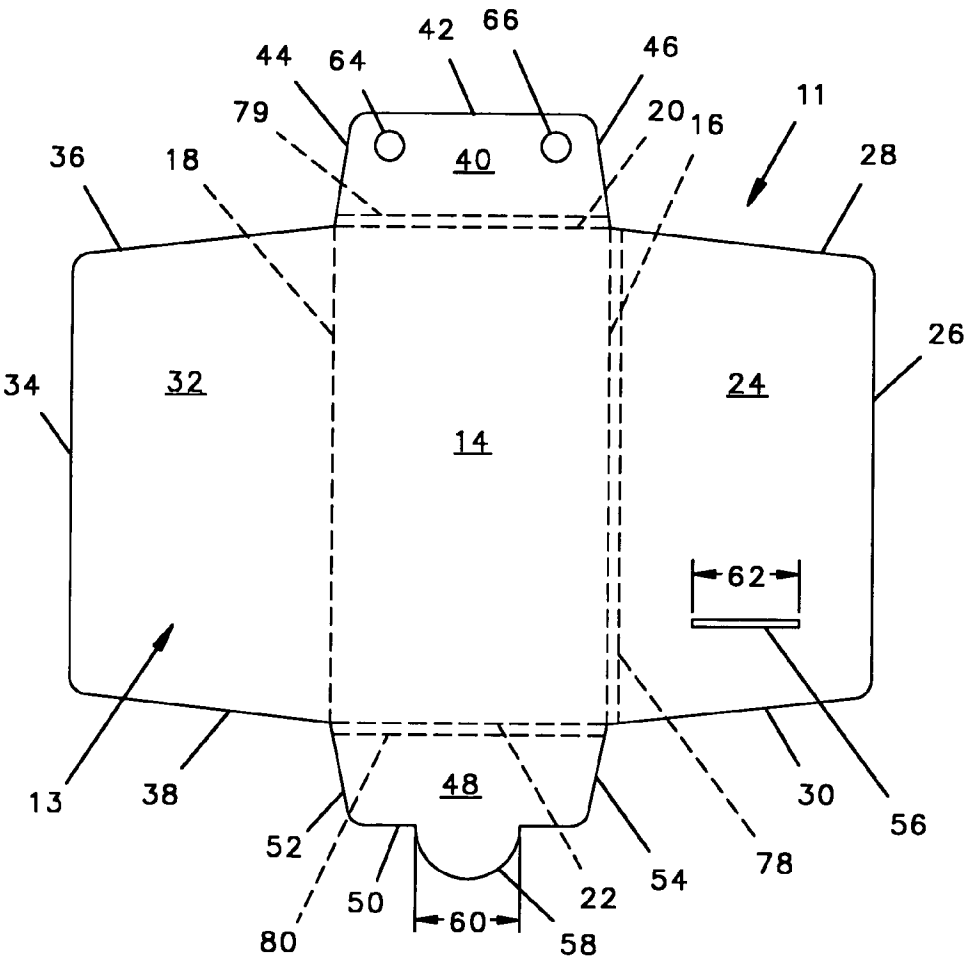
FIG. 1 is a front elevational view of a blank which may be folded to form a bank envelope in accordance with the present invention.

Referring further to FIG. 1, the blank 11 may have a number of perforated lines therein to enable bank customers to separate the various panels of the blank 11. Specifically, extending parallel to long side 16 and short sides 20 and 22 of the back panel 14 are perforations 78, 79, 80 respectively to facilitate the removal of coupons or the like printed on the front panel 24 or the first and second end panels 40, 48. To facilitate the removal of the coupons, the adhesive material 64, 66 that binds the first end flap 40 against the front panel 24 is preferably non-drying so that the envelope 10 can be disassembled without tearing or otherwise damaging the material from which envelope 10 is made.

To minimize the cost of the bank envelope 10, an advertising contract may be executed with the independent institutions 70, 71, 74 with the revenue obtained as a result of the advertising material 68, 69, 72 applied to the outer surface of the envelope 10 used to pay for the cost of manufacturing and delivering the envelope to the banking institution 65. As a result thereof, the banking institution can issue cash proceeds in an envelope 10 with a minimum of cost, or with no cost, or even generate a profit. As an alternative to supplying its own envelopes, an independent printing and advertising firm may manufacture bank envelopes with advertising material 67 thereon to promote the banking institution 65 and include advertising material 68, 69, 72 related to other business institutions 70, 71, 74 from whom advertising fees can be collected. Accordingly, the advertising agency or the printing company may supply envelopes 10 to a banking institution 65 without charge.

As can be seen, the present invention permits a banking institution to provide bank envelopes 10 to customers without incurring the cost presently associated with the provision of such envelopes.

While the present invention has been described and disclosed with respect to a single embodiment, it will be appreciated that many modifications and variations may be made without departing from the true spirit and scope of the invention. It is therefore the intent of the appendant claims to cover all such variations and modifications which fall within the spirit and scope of the invention.

What is claimed is:

1. An envelope made from a blank of material comprising a rectangular back panel having parallel long sides, parallel short sides, an inner surface and an outer surface, a generally rectangular front panel having opposing long sides, opposing short sides, an inner surface and an outer surface, a first of said long sides of said back panel joined to a first of said long sides of said front panel, a generally rectangular inner panel having opposing long sides and opposing short sides, a second of said long sides of said back panel joined to a first of said long sides of said inner panel, a first end flap having a side joined to a first short side of said back panel and a surface bonded to one of said inner surface and said outer surface of said front panel, said surface of said first end flap bonded to said one of said inner surface and said outer surface of said front panel by a adhesive that allows the subsequent separation of the parts without causing damage thereto, a second end flap having opposing sides, an inner surface and an outer surface, a first of said opposing sides of said second end flap hingeably joined to a second of said short sides of said back panel, one of said surface of said second end flap and a surface of said front panel having a slot therein, and a tab on the outer of said second of said second end flap and said front panel for removably engaging said slot for removably joining said second flap against a surface of said front panel.

2. The envelope of claim 1 and further comprising a perforation separating said back panel from one of said inner panel, said front panel, said first end flap and said second end flap.

3. The envelope of claim 2 and further comprising advertising material for an institution other than the institution issuing said envelope printed on said one of said inner panel, said front panel, said first end flap and said second end flap.

4. The envelope of claim 3 and further comprising advertising material for the institution from which said envelope was issued printed on an outer surface thereof other than said one of said inner panel, said front panel, said first end flap, and said second end flap.

* * * * *